US007611108B2

(12) United States Patent
De Backer

(10) Patent No.: US 7,611,108 B2
(45) Date of Patent: Nov. 3, 2009

(54) SANITARY ELEMENT SYSTEM WITH A SYSTEM INTERFACE

(75) Inventor: Gerard De Backer, Arolsen (DE)

(73) Assignee: HEWI Heinrich Wilke GmbH, Bad Arolsen (DE)

( * ) Notice: Subject to any disclaimer, the term of this patent is extended or adjusted under 35 U.S.C. 154(b) by 553 days.

(21) Appl. No.: 11/192,541

(22) Filed: Jul. 28, 2005

(65) Prior Publication Data

US 2006/0022098 A1 Feb. 2, 2006

(30) Foreign Application Priority Data

Jul. 28, 2004 (DE) ..... 20 2004 011 768 U

(51) Int. Cl.
*A47F 5/00* (2006.01)
*F16B 45/00* (2006.01)

(52) U.S. Cl. ..... 248/222.11; 248/304; 248/205.1

(58) Field of Classification Search ..... 248/222.11, 248/304, 315, 339, 205.1, 223.41, 224.51, 248/224.61, 231.91, 221.11
See application file for complete search history.

(56) References Cited

U.S. PATENT DOCUMENTS

| | | | | |
|---|---|---|---|---|
| 2,516,907 | A * | 8/1950 | Penfold | 285/7 |
| 5,372,346 | A * | 12/1994 | Upchurch et al. | 248/304 |
| 5,560,575 | A * | 10/1996 | Krysiak | 248/222.12 |
| 6,196,756 | B1 * | 3/2001 | Leverger | 403/326 |
| 6,334,597 | B1 * | 1/2002 | Ming-Hsiao | 248/305 |
| 6,371,313 | B1 * | 4/2002 | Walter et al. | 211/123 |
| 7,093,742 | B2 * | 8/2006 | Steven et al. | 224/197 |
| 7,322,551 | B2 * | 1/2008 | Simonsen | 248/231.81 |
| 7,387,285 | B2 * | 6/2008 | Thomason et al. | 248/226.11 |
| 2005/0263655 | A1 * | 12/2005 | Bauer | 248/223.31 |

FOREIGN PATENT DOCUMENTS

| | | |
|---|---|---|
| DE | 1775748 | 10/1958 |
| DE | 1841077 | 11/1961 |
| DE | 1887455 | 2/1964 |
| DE | 2404811 A1 | 8/1975 |
| DE | 2821368 A1 | 11/1979 |
| DE | 3239106 C1 | 2/1984 |
| DE | 8436244.8 U1 | 3/1985 |
| DE | 8807955.4 U1 | 10/1988 |
| DE | 3736737 A1 | 5/1989 |
| DE | 8901671.8 U1 | 5/1989 |
| DE | 29920924 U1 | 4/2000 |
| DE | 20016433 U1 | 1/2001 |
| DE | 69430436 T2 | 12/2002 |
| DE | 20214735 U1 | 3/2003 |

(Continued)

*Primary Examiner*—J. Allen Shriver, II
*Assistant Examiner*—Steven M. Marsh
(74) *Attorney, Agent, or Firm*—Townsend and Townsend and Crew, LLP

(57) ABSTRACT

The invention relates to a system of a support element and at least two functional elements which can be used in the sanitary sector, with the support element being able to be coupled to each of the functional elements via a system interface and the system interface having a spigot-shaped element—at the support element side—with an outwardly biased latch element projecting out of said spigot-shaped element transversely to its longitudinal axis and the functional elements each having a tubular element corresponding to the spigot-shaped element and having a cut-out for the latch element.

2 Claims, 3 Drawing Sheets

FOREIGN PATENT DOCUMENTS

| | | | |
|---|---|---|---|
| EP | 0058405 | A1 | 8/1982 |
| EP | 0974716 | A2 | 1/2000 |
| EP | 1254626 | A1 | 11/2002 |
| EP | 1256298 | A2 | 12/2002 |
| JP | 2001146828 | A | 5/2001 |
| JP | 2001224486 | A | 8/2001 |

* cited by examiner

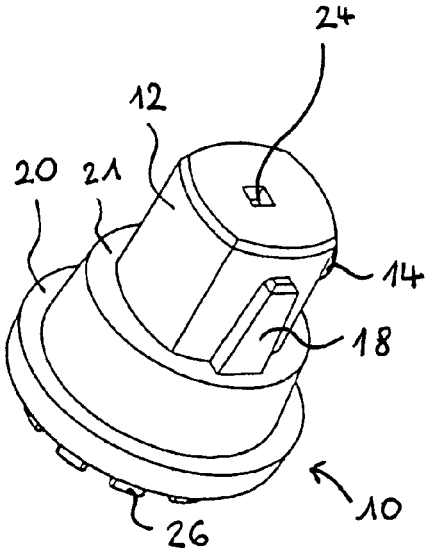
Fig. 3A
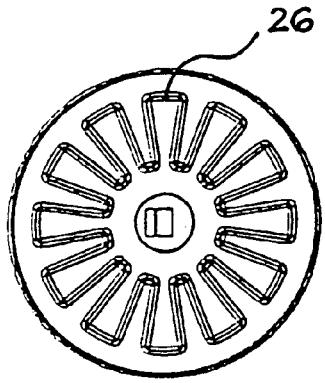
Fig. 3B
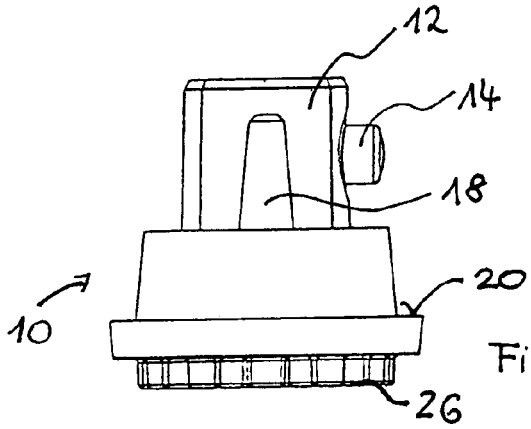
Fig. 3C
Fig. 4
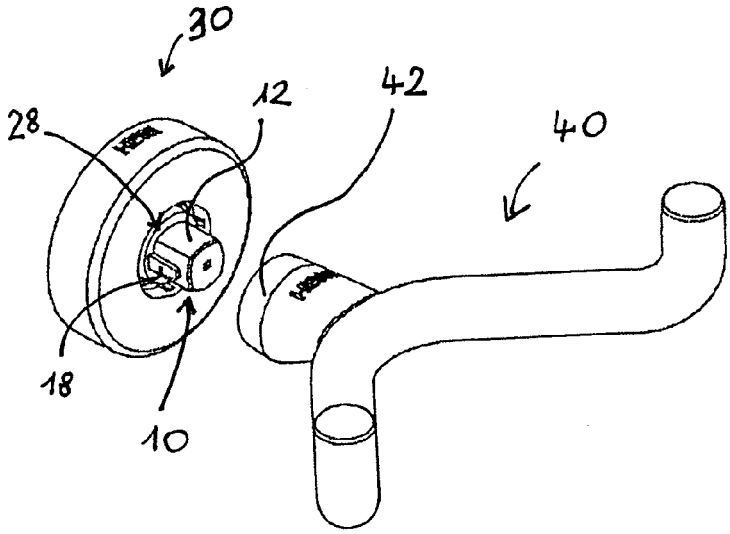

SANITARY ELEMENT SYSTEM WITH A SYSTEM INTERFACE

BACKGROUND OF THE INVENTION

The present invention relates to a system consisting of a support element and at least two functional elements which can be used in the sanitary sector.

The functional elements can, for example, be hooks, toilet roll holders, soap dishes, handles, holder elements or similar elements which are fastened to a wall surface extending vertically as a rule in the sanitary sector. Functional elements of this type have previously frequently simply been directly screwed in a wall with dowels. However, support elements which are screwed in a wall are also known which belong to a specific functional element matched to the respective support element and to which then the respectively matching functional element can be fastened. It is a disadvantage of a fastening of this type that, if a functional element is to be replaced by another one, as a rule the support element fixedly anchored in the wall also has to be replaced.

SUMMARY OF THE INVENTION

It is therefore an object of the present invention to provide a fastening system for functional elements usable in the sanitary sector which allows different functional elements to be fastened to a surface in as simple and nevertheless as stable a manner as possible so that they can be replaced by other functional elements without any great effort.

This object is satisfied in accordance with the invention by the features disclosed herein and in particular in that a system is provided consisting of a support element and at least two functional elements which can be used in the sanitary section and which can each be coupled to the support element.

The support element in accordance with the invention can be coupled to each of the functional elements via a uniform system interface, with this system interface having, at the support element side, a spigot-shaped element with an outwardly biased latch element projecting from it transversely to its longitudinal axis. The functional elements in turn each have a tubular element which corresponds to the spigot-shaped element and has a recess for the latch element.

Each functional element can therefore be pushed with its tubular element onto the spigot-shaped element, with the latch element projecting from the spigot-shaped element then latching into the recess in the tubular element provided for this purpose. In this manner, the functional element is secured both against rotation and against a pulling off from the support element. The tubular element with its recess provided therein is easy to realize and can be provided without any great difficulties at almost all functional elements to be used in the sanitary sector. On the building and fitting of a bathroom, for example, support elements in accordance with the invention can now already be provided at different positions by the contractor and a resident can later mount different functional elements of his choice on them.

In accordance with a preferred embodiment of the invention, the spigot-shaped element has at least one guide web which extends parallel to its longitudinal axis and converges in the direction of the functional element. Cut-outs which correspond thereto, which converge in the direction of the functional element and which extend parallel to its longitudinal axis, can then in turn be provided in the tubular element. When a functional element is pushed onto the support element, the guide web slides into the corresponding cut-out and the pushing on or the alignment of the functional element with respect to the support element is facilitated by the converging form. When the functional element is coupled to the support element, a guide web of this type then serves as an additional security against rotation in addition to the latching element.

In accordance with a particularly preferred embodiment of the invention, two converging guide webs of this type are provided at two oppositely disposed sides of the spigot-shaped element and then cooperate with two corresponding cut-outs in the tubular element. An optimum security against rotation is achieved by two oppositely disposed guide webs.

The support element can, for example, have a circular base surface at whose center the spigot-shaped element is seated. The spigot-shaped element itself can, for example, be cylindrical or also have any other cross-section desired. A circular base surface for the support element is to be preferred both for visual reasons and for technical production reasons; however, other embodiments are also feasible.

In accordance with a preferred embodiment of the invention, a base element is provided which can be fastened to a wall and to which the support element can be fastened or is fastened. A base element of this type can, for example, be a shield or a cover plate which has a screen and which is screwed tight to the wall. Fastening points provided, for example, at the wall for a supporting folding handle can be masked by a plate-like or shield-like base element of this kind when this handle is not intended to be used, or fitting holes left from previous installations can be masked. In addition to unused fastening points of this type, used fastening points can also be masked by a screen of this type: A shield-like wall plate can, for example, thus be provided which has a cut-out for a support element at one end and at whose other end a fastening point is provided for the screwing of a supporting folding handle or of a towel rack. Greater forces are introduced into the base element via supporting folding handles or towel racks than via the functional elements in accordance with the invention so that the system interface in accordance with the invention itself is not necessarily suitable to serve as a fastening for supporting folding handles or towel racks.

Base elements are also conceivable to which a plurality of support elements in accordance with the invention can be fastened at the same time.

The base element can have a cut-out into which the support element can be inserted for the fastening of the support element. If the support element has a circular base surface, a circular cut-out can accordingly, for example, be provided at the base element. The support element can be screwed to the base element from the rear while seated in the cut-out and can no longer slip due to the fit in the cut-out. A design of this type allows a particularly unobtrusive and stable fastening of the support element to the base element.

The front surface of the spigot-shaped element facing in the direction of the functional element preferably lies in a plane with the front surface of the base element facing in the direction of the functional element. The support element is therefore countersunk in the cut-out of the base element so that it does not project out of it, which improves the visual impression both with a mounted functional element and with no functional element mounted. In addition, a substantially planar surface is obtained in this manner even if no functional element is fastened to the support element so that injuries due to projecting parts of the support element are avoided.

If, as described above, the support element is inserted into a cut-out in a base element, it can have a toothed arrangement at its rear side which is made in a complementary manner to a corresponding toothed arrangement in the cut-out in the base element. The support element is thus additionally secured against rotation with respect to the base element.

The outward biasing of the latch element can be obtained, for example, with the help of a spring supported in the spigot-shaped element. The latch element can then easily be pressed against its bias in the direction of the axis of the spigot-shaped element so that a functional element can be pushed onto the spigot-like element in order then to latch into the recess provided in the tubular element for this purpose.

An opening accessible from the outside can be provided in the functional element and the latch element can be pressed radially inwardly through it against its bias by means of a tool to release the coupling of the functional element to the support element when the functional element is coupled to the support element. The latching of the support element to the functional element can, for example, thus be released with the help of a simple pin or screwdriver so that the functional element can be removed and, where desired, replaced by another.

The invention will be described in more detail in the following with reference to preferred embodiments and to the attached drawings.

BRIEF DESCRIPTION OF THE DRAWINGS

FIG. 3A is a perspective view of a further support element;

FIG. 3B is a plan view of the rear side of the support element of FIG. 3A;

FIG. 3C is a side view of the support element of FIGS. 3A and 3B;

FIG. 4 is the support element of FIGS. 3A-C with a base element and a functional element to be fastened to the support element.

DESCRIPTION OF THE PREFERRED EMBODIMENTS

Figure 1:
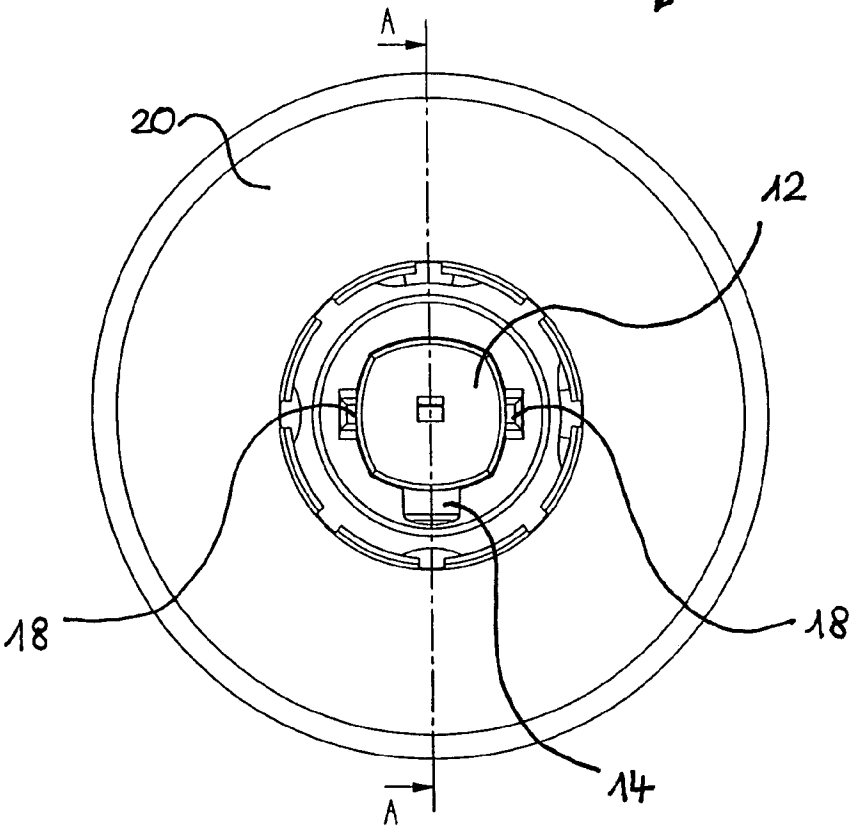
FIG. 1 is a plan view of a support element.

FIG. 1 shows a plan view from the front of a support element 10 in accordance with the invention with a circular base surface 20. A spigot-shaped element 12 which projects out of the plane of the drawing and has a substantially square cross-section with slightly arched outer sides is seated at the center of the circular base surface 20 of the support element 10.

Figure 2:
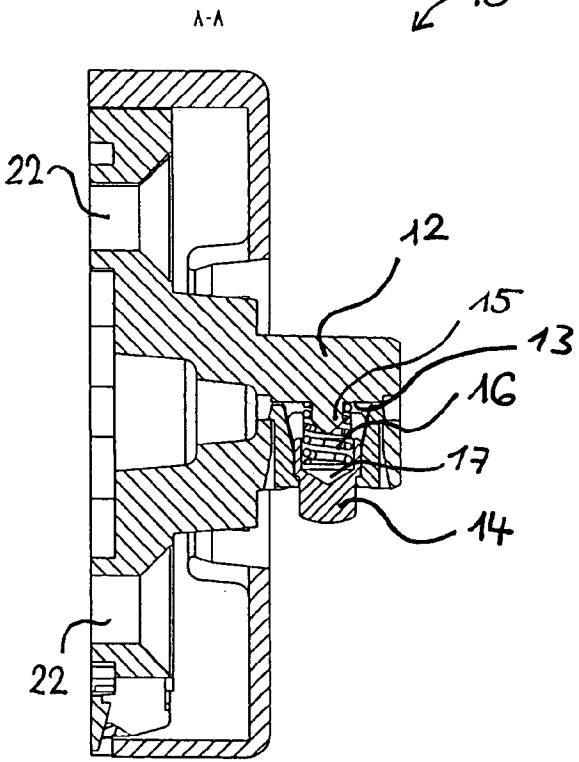
FIG. 2 is a section along the axis A-A through the support element of FIG. 1.

A latch element 14 made as a cylindrical pin can be seen at the side of the spigot-shaped element 12 at the bottom in FIGS. 1 and 2 and projects out of this element. As can be seen in FIG. 2, the latch element 14 is held or fixed in the spigot-shaped element 12 by means of a plastic sleeve and is supported at a spring centering location 15 in the interior region of the spigot-shaped element 12 by a spring 16, with the spring 16 being seated in a bore 17 of the latch element 14 and extending from this bore 17 up to and approximately into the center of the spigot-shaped element 12. When the spring is compressed, the latch element 14 is countersunk in the spigot-shaped element 12 until it abuts an abutment surface 13 provided for this purpose with the annular surface bounding the end of the bore 17. In the position countersunk up to the abutment surface 13, it no longer only projects from the spigot-shaped element 12, but it projects from the spigot-shaped element 12 when the spring 16 is relaxed and can thus latch into a corresponding cut-out in a tubular element of a functional element.

In FIG. 1, two guide webs 18 are furthermore shown which extend perpendicular to the plane of the drawing at oppositely disposed sides of the spigot-shaped element 12. These guide webs 18 converge toward the front in the direction of a functional element to be pushed on so that the pushing on of the functional element is facilitated which has cut-outs corresponding to the guide webs 18 in its tubular element. When the functional element is coupled to the support element 10, the guide webs 18 form an additional security against rotation.

In FIG. 2, in addition, two of four bores 22 are visible which are provided in circular form in the rear side of the support element 10. The bores 22 serve for the screwing of the support element 10 directly to a wall or to a base element as will be explained later.

FIGS. 3A to 3C show different views of another embodiment of a support element 10 in accordance with the invention. In FIG. 3A, the support element 10 is shown in a perspective manner and a circular base surface 20 can be seen on which a cylindrical body 21 is seated at whose center the spigot-shaped element 12 is in turn located.

The spigot-shaped element 12 also has a substantially square cross-section with slightly arched outer sides, with two guide webs 18 being disposed at the outer side, which converge in the direction of a functional element and of which, however, only one can be see in the Figures. A quadrangular opening 24 is applied at the surface at the center of the spigot-shaped element 12. At the outer side of the spigot-shaped element 12 adjacent to the guide web 18, the latch element 14 can be seen in FIG. 3C which projects out of the spigot-shaped element 12 at the side (downwardly with a mounted support element 10) and has a cylindrical shape with a rounded end face.

Figure 5:
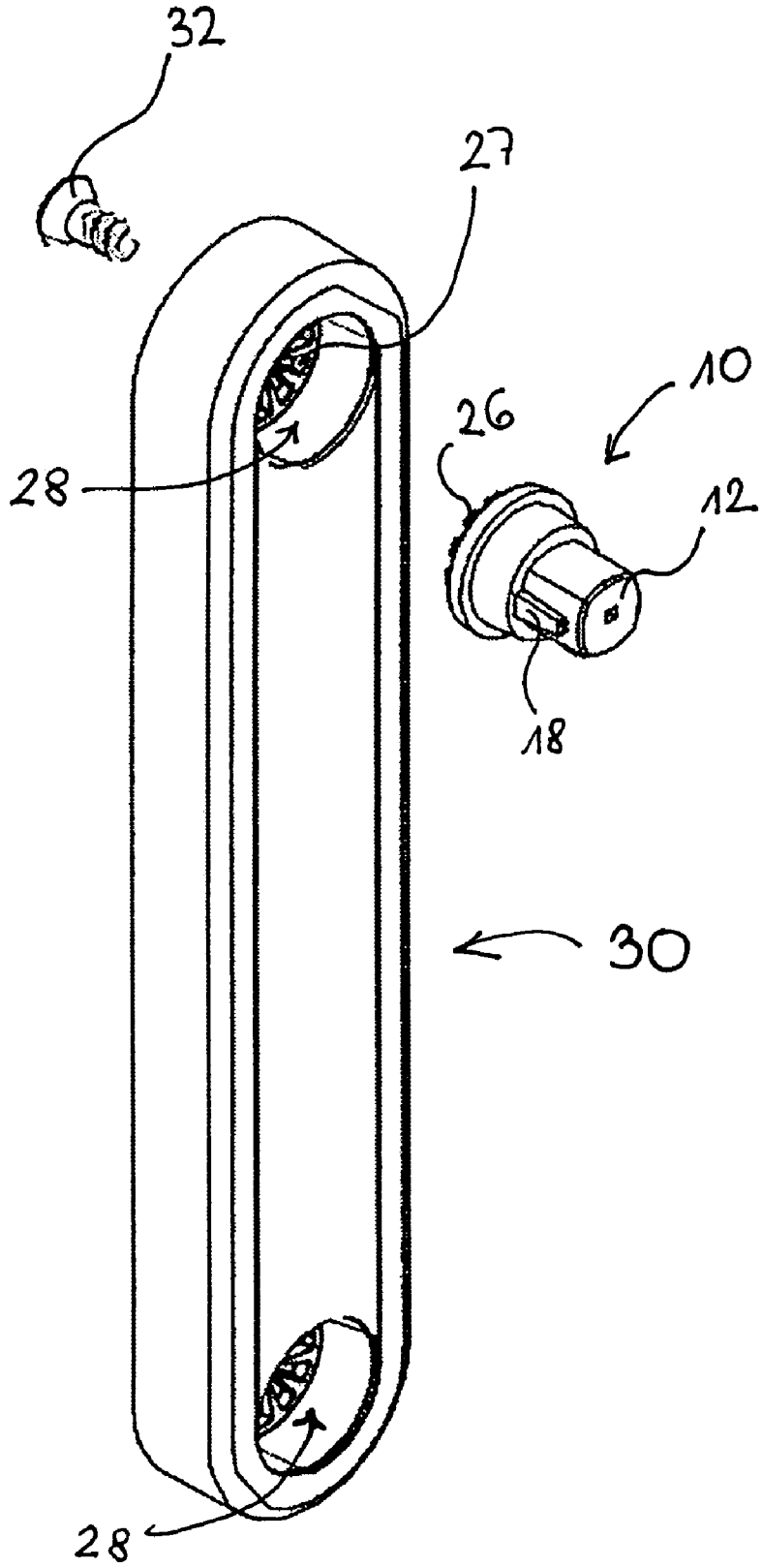
FIG. 5 is a perspective representation of a further base element with two cut-outs for support elements and a support element to be fastened thereto.

The lower side of the support element 10 is provided with a star-shaped toothed arrangement 26 which is shown more precisely again in a plan view in FIG. 3B. This toothed arrangement 26 can, as shown in FIG. 5, cooperate with a corresponding toothed arrangement 27 in a cut-out 28 of a base element 30 whose shape corresponds to the shape of the base surface 20 of the support element 10 when the support element 10 is inserted into a cut-out 28 of this type and can thus form a security against rotation.

In FIG. 4, the support element 10 from FIGS. 3A to 3C is now inserted into a circular base element 30 or is made in one piece with the base element 30. The base element 30 can be screwed firmly to a wall and has a circular base surface at whose center a likewise circular cut-out 28 for the support element 10 is provided whose diameter corresponds to the diameter of the base surface 20 of the support element 10. The latch element 14 is not visible in FIG. 4 since it lies at the lower side of the spigot-shaped element 12; however, the guide web 18 can be seen on the left-hand side of the spigot-shaped element 12.

In addition, a functional element 40 is shown in FIG. 4 which can be pushed onto the support element 10. The functional element 40 is a double hook which has a tubular element 42 with which it is mounted onto the support element 10. The inner cross-section of the tubular element 42 corresponds to the outer cross-section of the spigot-shaped element 12, with two cut-outs also being provided which are not visible in the Figure and which correspond to the guide webs 18. In addition, a cut-out (again not visible in the Figure) for the latch element 14 is formed at the lower side of the tubular element 42.

To push on the functional element 40, the latch element 14 is depressed against its bias transversely to the direction of the longitudinal axis of the spigot-shaped element and then latches into the recess in the tubular element 42. In the latched state, the support element 10 is firmly coupled to the functional element 40 so that the functional element 40 is secured against rotation and against being pulled out. The support element 10 is completely invisible in this coupled state and the tubular element 42 of the functional element 40 is seated in a shaped matched manner in the cut-out 28 of the base element 30.

FIG. 5 likewise shows the support element 10 of FIGS. 3A to C and of FIG. 4, but this time with a different base element 30. The base element 30 is an elongate shield which can be screwed to a wall and which has two cut-outs 28 for support elements 10. The two circular cut-outs 28 are provided at the front side at the end regions of the shield 30 remote from one another and each have a toothed arrangement 27 which cooperates with the toothed arrangement 26 at the rear of the support element 10. Unused fastening points can, for example, be masked behind the shield 30. The screw 32 serves for the screwing of the support element 10 in the cut-out 28.

Instead of the double hook shown in FIG. 4, any desired other functional elements usable in the sanitary sector can be combined with the support element 10 in accordance with the invention. For example, paper holders, soap dishes, toothbrush holders, handles and hooks, cosmetic holders and similar are thus feasible so that a plurality of combination possibilities are created with different conceivable base elements.

The invention claimed is:

1. A system of support which can be used in the sanitary sector, comprising:

a support element having a rear side and a support element side, being able to be coupled to a plurality of functional elements via a system interface and the system interface having a spigot-shaped element, at the support element side, with an outwardly biased latch element projecting out of said spigot-shaped element transversely to its longitudinal axis;

at least one functional element having a tubular element corresponding to the spigot-shaped element and having a cut-out for the latch element; and a base element which can be fastened to a wall and to which the support element can be fastened, wherein the support element has a toothed arrangement at its rear side which is complementary to a corresponding toothed arrangement at the base element.

2. A system of support which can be used in the sanitary sector, comprising:

a support element having a rear side and a support element side, being able to be coupled to a plurality of functional elements via a system interface and the system interface having a spigot-shaped element, at the support element side, with an outwardly biased latch element projecting out of said spigot-shaped element transversely to its longitudinal axis;

at least one functional element having a tubular element corresponding to the spigot-shaped element and having a cut-out for the latch element; and a base element which can be fastened to a wall and to which the support element can be fastened, wherein the support element is screwed at the rear side to the base element.

* * * * *